United States Patent [19]

Scott et al.

[11] 3,983,440

[45] Sept. 28, 1976

[54] DISCHARGE LAMP COMPONENT

[75] Inventors: Kenneth Scott; Arthur Samuel Vause, both of London, England

[73] Assignee: Thorn Electrical Industries Limited, London, England

[22] Filed: May 23, 1975

[21] Appl. No.: 580,283

Related U.S. Application Data

[63] Continuation-in-part of Ser. No. 321,797, Jan. 8, 1973, abandoned.

[52] U.S. Cl. ..... 313/217; 29/25.17; 313/176; 313/177; 313/178; 313/179; 313/346 R; 313/356; 316/25; 316/26

[51] Int. Cl.[2] ..... H01J 61/06

[58] Field of Search ..... 313/217, 346 R, 356, 313/174, 176, 177, 178, 179, 181, 352, 353; 29/25.17; 316/24, 25, 26

[56] References Cited

UNITED STATES PATENTS

| | | | |
|---|---|---|---|
| 3,121,182 | 2/1964 | Hui et al. | 313/178 |
| 3,387,908 | 6/1968 | Fogelson | 316/25 |
| 3,405,303 | 10/1968 | Koury et al. | 313/217 |

*Primary Examiner*—R. V. Rolinec
*Assistant Examiner*—Darwin R. Hostetter
*Attorney, Agent, or Firm*—Kemon, Palmer & Estabrook

[57] ABSTRACT

An electric discharge lamp includes a structure within the discharge envelope comprising a source of at least one halogen, metal or metal halide to serve as an arc-modifying additive, enclosed in the structure from which it is capable of being released into the discharge envelope upon subsequent treatment, for example on heating or on striking an arc. The structure preferably comprises a hollow carrier body of refractory metal, in which the source of halogen, metal or metal halide is disposed, and may be covered by a closure of porous sintered refractory metal or of fusible metal. The fusible metal may be inert as regards the discharge and may itself affect the emitted radiation characteristics. The structure may constitute one electrode of the lamp, and may also include electron-emissive material. It has the advantage of protecting the additives from the atmosphere and thereby simplifying manufacture of the lamp.

15 Claims, 5 Drawing Figures

DISCHARGE LAMP COMPONENT

This application is a Continuation-in-Part of our Application Ser. No. 321,797 filed Jan. 2, 1973, now abandoned.

This invention relates to electric discharge lamps, and more especially to the so-called "high pressure" discharge lamps, which comprise a fused silica or ceramic discharge tube enclosed in an outer envelope.

In such lamps it is known to include at each end of the discharge tube an electrode which serves to pass electricity from a supply to the discharge and to assist the passage of current through the discharge by reason of its electron-emissive properties. Such electrodes are normally made of tungsten or other refractory metals and frequently have surface coatings or internal inclusions of electron-emissive materials, such as oxides or aluminates of alkaline earths.

It is also known that high pressure lamps may use, in addition to mercury, sodium metal such that the partial pressure of mercury is about 2 atm. and the partial pressure of sodium is to ½ atm. so that the primary radiation is that of the element sodium, giving radiation primarily on either side of the resonance lines at 589.0 nm. and 589.6 nm., the resonance lines being partially or wholly absorbed. It is further known to use mercury within discharge tubes together with the halides of other metals, e.g. aluminium, disprosium, gallium, indium, scandium, sodium, thallium, thorium or tin, which give characteristic additions to the luminous output of the lamp over and above the radiation generated by the mercury.

In these lamps based on mercury and metal halides the ingredients are added by a variety of methods. For example, the salts of the metals may be dispensed by volume or by weight and introduced into the lamp by way of a connection tube, and this may be done at one of several stages during lamp processing after the arc tube ends have been sealed and the cathodes positioned.

Moreover, in the high pressure sodium lamp the sodium and mercury are introduced into the arc tube by weight or by volume, either individually or as an amalgam.

The electrodes used for these discharge lamps are generally formed by one of two techniques. One technique is to fabricate shapes and structures from tungsten or tungsten alloy wire or sheet and to impregnate or coat these with electron-emissive materials. The other technique is to produce structures by powder metallurgy using tungsten and/or other refractory metals. Emissive materials are either surface coated on or included in the body of these structures for use in discharge lamps.

This invention is characterized by the provision of a structure within the discharge envelope comprising a source of at least one halogen, metal or metal salt and capable of releasing such substance, either directly or by chemical reaction, into the discharge envelope upon subsequent treatment. The release or chemical reaction may be brought about by heating, by the presence of a discharge or by the action of other materials included in the discharge space. The generated substances may serve to influence the character of the discharge, for example as described above for high pressure sodium and metal halide discharge lamps, or to getter contaminant or unwanted gases or vapours within the discharge space, or to perform both these functions. Where the structure is an electrode, any such function is in addition to the other function of the structure in assisting electron emission within the lamp.

The characteristic structure of this invention preferably comprises a carrier or support composed of tungsten or other refractory metal, which may be made by powder metallurgy methods, and which may in some cases be used as an electrode for the lamp or may be used separately merely as a carrier or support for the aforementioned source materials of substances to be introduced.

Some halogen-generating materials which may be used are hygroscopic, e.g. sodium iodide, and it is known that moisture is deleterious to the discharge. It is therefore essential to protect such materials from the natural atmosphere and/or from atmospheres attendant on lamp-making processing. This can be achieved by appropriate formation of the refractory structure.

The source materials or additives incorporated in the structure, including electron-emissive materials are therefore contained in a cavity in the structure and covered by a closure or cover serving to protect the contents of the structure from contact with the atmosphere before their release into the discharge envelope. The closure may be of sintered refractory metal which permits and controls dispensing of the additives by evaporation or sputtering into the discharge space.

In an alternative form of the invention, the cover enclosing the additives in the cavity is composed of fusible metal or includes a closure element or plug of such metal.

In manufacturing a lamp incorporating this form of the invention a source of the additive elements is introduced into the cavity of the refractory structure, a cover consisting of or including the fusible metal closure is applied and the resulting component is fitted into the lamp envelope. If the structure is to constitute an electrode it will be mounted on an appropriate conductive support or lead. When the remaining components have been fitted and, where necessary, sealed into the envelope, for example by conventional pinch sealing techniques, the envelope is exhausted and the gas fill, usually mercury and an inert gas and possibly gaseous halogen also, is introduced in the usual way. The envelope is then sealed and the fusible metal closure is fused to release the additive material or permit its diffusion during operation of the lamp.

The refractory body is preferably non-porous and may be formed in various ways. For example, it may be a high density sintered body of refractory metal formed with a moulded cavity or a close-pitch helical coil of refractory metal surrounding and projecting from a rod of refractory metal and welded to close the gaps between adjacent coil turns, or it may be a solid refractory metal body having an axial cavity drilled in it.

The cover for any of these bodies or cavities may take a variety of forms. For example, it may be a generally cylindrical or annular element of refractory metal the centre of which is drilled and fitted with a fusible metal plug. Alternatively it may be a welded, close-pitch refractory metal coil of sufficient diameter to enclose the end of the body and fitted with a disc closure of fusible metal. A further simple alternative is a fusible metal plate shaped and dimensioned to close the cavity in the body.

The fusible metal closure may be of a high melting point metal such as tungsten, which can be fused, for example, by a laser beam and which, after fusion, plays no further part in affecting the radiation characteristics of the lamp. This type of closure can be used in any type of discharge lamp.

Alternatively, the closure may be made of a more readily fusible metal which is, however, non-reactive with the additive enclosed within the component and with other elements contained within the arc tube. Examples of such metals include molybdenum, nickel and stainless steel and these metals are suitable for use in lamps including arc-modifying metals but preferably not when halogens are present.

As a further alternative, the closure may be of an active metal, for example thorium or scandium, which can react with halogen present and exhibits a demonstrable participation in the discharge radiation. Such closures are of particular interest in the fabrication of metal-halide discharge lamps.

It is also possible to use for the fusible closure a metal having gettering properties, such as titanium, tantalum or zirconium, or niobium.

The periphery of the cover may be sealed to the adjoining areas of the body by appropriate means, for example by laser seam welding. It has been found that this operation can be conducted without causing a detrimental rise in temperature of the contents of the cavity. It is desirable that the arc-modifying additives should be placed in the cavity under controlled environmental conditions, e.g. in a "dry box", and that the closure should be placed in position under the same conditions before transfer to the sealing operation.

The practice of this invention may be more clearly understood by means fo the following examples, which are described with reference to the accompanying drawings. In the drawings.

In all the structures shown a tungsten or molybdenum rod is used as a support member and as a means for connecting the electrode through the discharge tube seal to the electricity supply.

Figure 1:
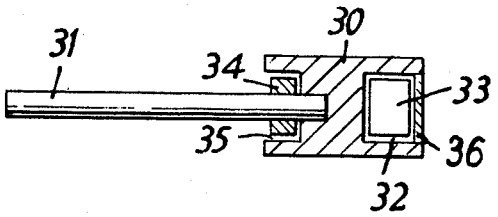
FIG. 1 shows one example of a refractory structure made by powder metallurgical methods for the purposes of this invention.

The structure shown in FIG. 1 includes a sintered tungsten powder matrix supported by a tungsten or molybdenum rod. The matrix 30 carried by the rod 31 includes cavities 32 and 35 in which are located pellets of halogen generating material 33, for example sodium iodide, and electron-emissive material 34 respectively. The cavity containing the sodium iodide may be closed by a sintered refractory cover 36, which further protects the substance from atmospheric action and may control dispensing of the material during heating or bombardment by ions or electrons.

The matrix or body 30 can be readily made by moulding and sintering using conventional powder metallurgy techniques well known in the art. The cover body 36 can likewise be formed as a sintered body and be secured to close the cavity by suitable known techniques, for example by laser welding. The cover 36 by virtue of its sintered structure is sufficiently porous to permit dispensing of the vaporized additive therethrough.

The control of dispensing of the active substance from the source material can also be implicit in the physical properties of the material. For example, a material may be chosen having a high boiling point and dissociation temperature, for example barium iodide, which is substantially unaffected by temperatures encountered in lamp manufacturing processes but which when subsequently intentionally heated by known means to a higher temperature will provide a means of dispensing halogen.

It is equally contemplated that a single pellet may comprise a composite of generating and emissive materials, or that pellets of both types may be contained in the same cavity or respective cavities.

After lamp processing, when the discharge tube has been substantially exhausted of air, and rare gas and mercury metal have been introduced and the discharge tube sealed from the atmosphere, the discharge tube may be operated either separately or included in its outer envelope, as a seasoning stage prior to the normal use of the lamp. During this process, or by some other means such as electrical induction heating, or by heating the electrodes by the passage of a current between them, the materials are transported, as by evaporation or sputtering, from the structure into the discharge space so that they may there influence the discharge or the emission of radiation.

Figure 2:
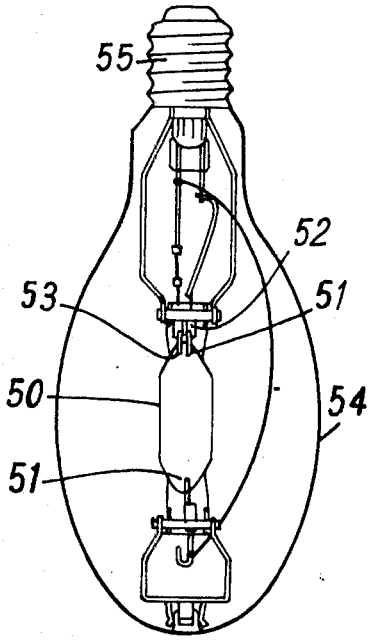
FIG. 2 shows a typical discharge lamp in which the invention can be employed.

The finished lamp may be of the type shown in FIG. 2. The lamp includes an arc tube or discharge envelope 50 containing a gas fill and fitted with electrodes 51 supported by lead-in wires 52 passing through the press seal of the tube. An auxiliary starting probe 53 is also provided in the tube. Either or both of the electrodes 51 may be constituted by structures according to this invention. The arc tube 50 is supported in an outer envelope 54 terminating in a base 55 in a conventional manner, as shown.

In an alternative arrangement the dispensing structure may be separate from the electrodes, and may be heated separately by means known in the art or by passing a discharge from either or both of the electrodes to the dispensing structure in order to remove the additives from the structure and introduce then into the discharge space.

The halogen generating materials, or metal halides hereinbefore described, as well as the electron-emissive materials, whether in pellet or particle form may also be mixed with or surrounded by refractory metals or oxides, for example tungsten, as a means of controlling dispensing during heating or bombardment by ions or electrons.

Figure 3:
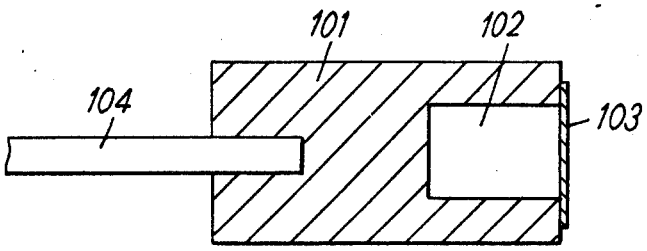
FIG. 3 is a longitudinal section of a second form of discharge lamp component according to the invention.

The component shown in FIG. 3, which is intended to constitute one electrode of the lamp, comprises a cylinder 101 cut from drawn tungsten rod, in one face of which a coaxial cavity 102 has been formed by laser drilling. The cover 103 for the cavity is a sintered disc of tungsten or other metal and the structure is mounted on a tungsten rod 104 press-fitted into a coaxial cavity drilled in the opposite face of the tungsten cylinder.

Figure 4:
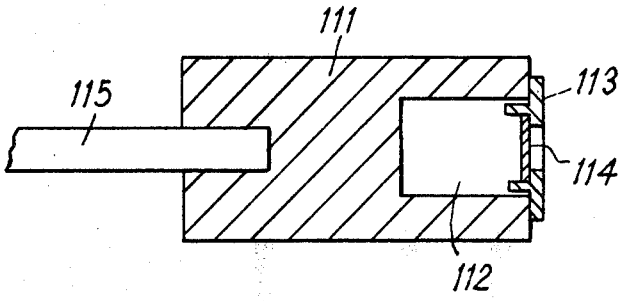
FIG. 4 is a similar section of a third form of component.

FIG. 4 shows a high density sintered tungsten body 111, formed by powder metallurgy techniques with a preformed cavity 112. The cover 113 is a high density sintered tungsten flanged disc the centre of which is fitted with a fusible metallic plug 114. The structure is mounted on a tungsten rod 115 press-fitted into a cavity also formed in the body.

Figure 5:
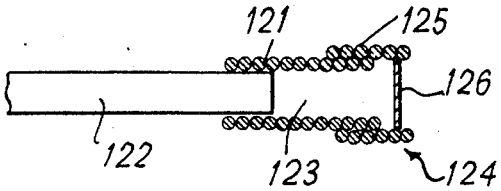
FIG. 5 is a corresponding section of a fourth form of component.

FIG. 5 shows a welded close-pitch tungsten coil 121 surrounding and projecting over a tungsten rod 122 to define a cavity 123. The cover 124 is a second welded close-pitch tungsten coil 125 of diameter sufficient to enclose the first coil and is fitted with a top disc closure 126.

In the currently preferred practice of the invention, and when using a component of the form shown in FIG. 3, selected metals such as scandium, sodium or barium may be loaded in amalgamated, pellet or powder form into the cavity 102 of the structure shown. This operation is performed in a dry-box in which the atmosphere is substantially pure nitrogen and in which oxygen and water vapour in particular are controlled below 5 ppm. The cavity is covered by the metal disc 103 which, after the component has been sealed inside a discharge tube will be fused in order to release the enclosed metals. Conveniently this disc can be of tungsten or a metal with arc-modifying properties, for example scandium or thorium. The joint between the cover and the body can be made by seam welding around the periphery of the cover using a laser. For example, a neodymium glass laser pulsed at between 5 and 60 pulses per second with its output focussed on the edge of the closure disc will effectively seal the disc to the rim of a cavity in tungsten or refractory metal. Rotation of the disc and cavity is required, dependent on the pulse rate of the laser, to secure overlapping of individual welds produced by individual pulses.

It has been found that pulses of 1.5 joules lasting 2.9 milliseconds and occurring at a rate of 25 pulses per second, will satisfactorily seam weld a tungsten cover 1.65 mm diameter and 0.25 mm thick onto a body formed of drawn tungsten rod.

It has further been found that the structure can be pinchsealed satisfactorily into a fused silica discharge tube in known manner without loss of material from within the cavity.

The discharge tube is then exhausted of air and filled with a few milligrams of mercury and a low pressure of rare gas. There may also be added a quantity of halogen such as iodine or a halogen compound, such that during initial lamp operation the selected metals, when released, may combine with the halogen to form metal halides. The discharge tube is then hermetically sealed by known means.

Subsequently the metal closure is fused either by means of a laser beam directed onto the cover, more especially in the case of a tungsten cover, or preferably by initiating an arc between the component and another lamp electrode. The arc-modifying metals are released to participate in the discharge by virtue of their respective metal vapour pressures or, where halogen is also present, by reaction with the halogen to form metal halides.

In one example having the structure shown in FIG. 3, and fabricated as described above, the body consists of a 2.0 mm diameter tungsten cylinder cut 10 mm long from drawn rod, in which a coaxial cavity 1.3 mm diameter and 5.0 mm deep is formed by laser drilling, using three laser pulses each of 30 joules lasting 0.70 milliseconds.

The cover for the cavity is a 1.65 mm diameter disc of 0.25 mm thick tungsten.

The whole structure is mounted on a 0.6 mm diameter rod pressfitted onto a coaxial cavity in the opposite face of the tungsten cylinder.

It is evident however that a similar procedure can be carried out using structures fabricated in other ways, for example as shown in FIGS. 4 and 5.

What is claimed is:

1. In an electric discharge lamp comprising a discharge envelope, electrodes disposed therein for establishment of said discharge, a fill of gas therein, and at least one arc-modifying substance selected from halogens, metals and metal halides, the improvement which comprises a structure mounted within the discharge envelope and including: a refractory metal body formed with a cavity therein; a source of said arc-modifying substance contained in said cavity; and a cover closing said cavity and serving to protect said source from the environmental atmosphere; said source and structure being capable of releasing such substance into said discharge envelope upon subsequent treatment.

2. The lamp of claim 1 wherein said refractory metal body is a hollow sintered structure, and said cavity is closed by a cover of sintered refractory metal.

3. The lamp of claim 1 wherein said structure constitutes one electrode of the lamp.

4. The lamp of claim 1 wherein said substance is selected from the group consisting of sodium iodide, mercury iodide and barium iodide.

5. The lamp of claim 2 wherein said refractory metal is selected from the group consisting of tungsten and molybdenum.

6. An electrode for an electric discharge lamp comprising:

a carrier body of refractory metal having a cavity formed therein;

means providing a source of arc-modifying material selected from halogens, metals and metal halides disposed within such cavity;

a cover closing said cavity and adapted to protect said source means from the environmental atmosphere and to permit release of said material in operation of the lamp;

and refractory conductive support means to mount said body within a discharge lamp.

7. The electrode of claim 6 wherein said cover comprises a metal closure fusible when the lamp has been fabricated.

8. The lamp of claim 1 wherein said cover for the cavity comprises a fusible metal closure.

9. The lamp of claim 8 wherein said body is a solid refractory metal body having said cavity drilled in it.

10. The lamp of claim 8 wherein said body is constituted by a welded close-pitch helical coil of refractory metal formed round and projecting from one end of a refractory metal rod.

11. The lamp of claim 8 wherein said cover comprises a cylindrical element of refractory metal having a central aperture and a fusible metal plug closing said aperture.

12. The lamp of claim 8 wherein said cover comprises a welded, close-pitch refractory metal coil of a diameter to fit round said body, and a fusible metal plug closing the end of said coil remote from said body.

13. The lamp of claim 8 wherein said fusible metal has lamp-modifying properties selected from emission characteristic modifying and gettering properties.

14. A method of making an electrical discharge lamp comprising the steps of: fabricating a refractory body containing a cavity; introducing into said cavity a source of arc-modifying material; enclosing said material within said cavity by a cover comprising a metal closure; fitting the resulting component in a discharge lamp envelope together with other necessary electrodes and components; sealing said envelope; exhausting and gas-filling said envelope; and fusing said metal closure to release said material.

15. A method of making an electrical discharge lamp comprising the steps of: fabricating a refractory body containing a cavity; introducing a source of arc-modifying material into said cavity; enclosing said material within said cavity by means of a cover comprising sintered refractory metal; fitting the resultant component in a discharge lamp envelope together with other necessary electrodes and components; sealing said envelope; exhausting and gas-filling said envelope; and causing said material to be dispensed from said component into said envelope prior to normal operation of said lamp.

* * * * *